United States Patent [19]

Clerici

[11] Patent Number: 4,519,531

[45] Date of Patent: May 28, 1985

[54] PLEATING MACHINE FOR PLEATING CLOTH WITH MUTUALLY CONVERGING FOLDS

[76] Inventor: Giordano Clerici, Via Fernando Santi, 5, 20056 Trezzo Sull'Adda, Milano, Italy

[21] Appl. No.: 618,246

[22] Filed: Jun. 7, 1984

[30] Foreign Application Priority Data

Jun. 29, 1983 [IT] Italy ..... 21848 A/83
Oct. 10, 1983 [IT] Italy ..... 23229 A/83

[51] Int. Cl.[3] ..... A41H 43/00
[52] U.S. Cl. ..... 223/30
[58] Field of Search ..... 223/28, 30, 31

[56] References Cited

U.S. PATENT DOCUMENTS 3,333,559 8/1967 Benz ..... 223/30 X
4,245,576 1/1981 Crawford ..... 223/30 X

FOREIGN PATENT DOCUMENTS 3106606 10/1982 Fed. Rep. of Germany ..... 223/30

*Primary Examiner*—Louis K. Rimrodt
*Attorney, Agent, or Firm*—Browdy and Neimark

[57] ABSTRACT

The invention relates to the field of cloth pleating machines, and in particular, to a pleating machine for pleating cloth with mutually converging folds. The technical problem to be solved was that of providing a pleating machine which could also work accurately and reliably on highly flabby and/or hard-to-fold fabrics. The problem has been solved by providing a pleating machine having an angularly oscillating arm and an abutment wall for said arm, which are configured comb-like to be mutually interleaved, and provided with control and guiding devices for said wall which are operative to drive the same through a cyclic oscillation along a closed path causing said wall to move from a position close against a cloth to be pleated to one of insertion in said arm over and past a cloth flap which has been folded by said arm.

14 Claims, 18 Drawing Figures

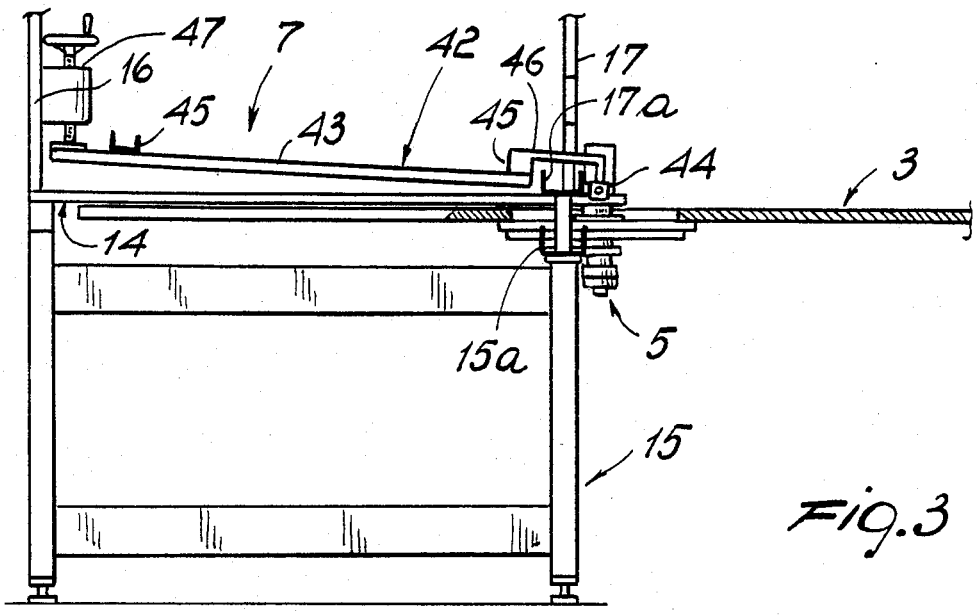
Fig.3
Fig.4
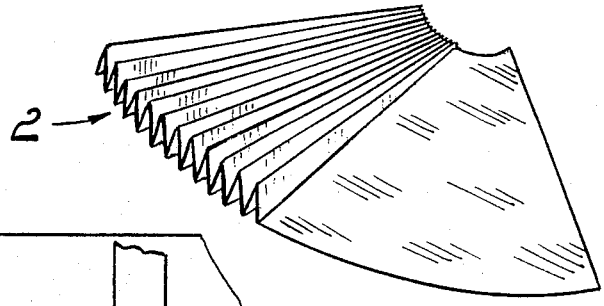
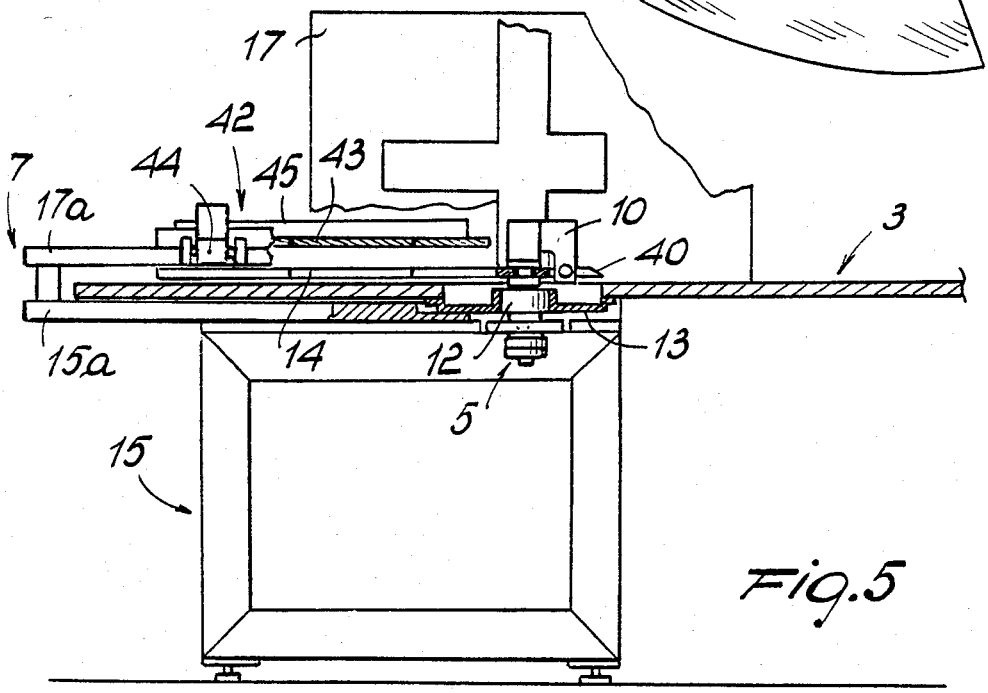
Fig.5

3
4
6
7
148
113b
113a
114b
114a
115b
115a
116b
116a
142
118
117
119
140
120
146
139
43
14
147
144
145
143
141
116b
115b
2

PLEATING MACHINE FOR PLEATING CLOTH WITH MUTUALLY CONVERGING FOLDS

BACKGROUND OF THE INVENTION

This invention relates to a pleating machine for pleating cloth with mutually converging folds, in particular a machine operative to form converging folds in the cloth and defining "upright" flaps therein i.e. folds extending crosswise to the face of a cloth piece to be pleated.

Pleating machines have been developed in the past which, to produce pleated cloth as above, were equipped with an angularly oscillating entrainment arm adapted to impart cloth to be pleated with a step-like forward movement, and with a movable abutment wall whereat said arm would form flaps or pleats.

The abutment wall was, in fact, arranged to initially act as an anvil member for the cloth being pleated, at the forward travel limit of the entrainment arm, and then raised and shifted to allow the formed pleats to move toward guiding members for the pleated cloth.

This prior approach, while seemingly workable, has proved inadequate to provide pleated cloth of an acceptable quality. In fact, the upward movement of said walls tends to drag the pleated cloth therealong if the entrainment arm is held at a position close to the wall. In the opposite case, the position of the folded flap remains uncertain and the fold has inadequately defined edges. Furthermore, said wall, in returning to its starting position from above, may easily interfere with the flap just formed and squeeze it or at least contact it in a wrong position.

With very flabby fabrics, it has also been found that the entrainment arm is unable to displace such fabrics accurately in an angular direction; that portion of said fabrics which is not caught between the arm and abutment wall being more likely to follow a path of linear direct approach to the abutment wall than an arched path toward it.

Lastly, the various component members of such prior machines have complex constructions, and are not readily adaptable to meet changing requirements as regards the depth and inclination of the pleats.

For these reasons, pleated cloth formed with converging or so-called "soleil" folds, is mostly processed manually by inserting cloth portions between a pair of pleated cardboards, and then pressing said cardboards accordion-like and loading them into appropriate devices to set the cloth in its pleated condition by a heat treatment thereof.

However, is may be appreciated that such a technique is unsatifactory both time- and labor-wise, and that such empirical procedures are practically unacceptable where large volume production is involved.

SUMMARY OF THE INVENTION

It is a primary object of this invention to obviate the problems of prior art by providing a pleating machine which can form cloth with mutually converging folds in a rapid and economical way, as well as a qualitatively satisfactory one.

A further object of the invention is to provide a pleating machine which is highly reliable in operation, i.e. which can operate in a highly accurate manner to yield high quality pleated cloth even with flabby fabrics, without involving the availability of skilled personnel or critical adjustment practices.

It is another object of this invention to provide a pleating machine which is basically simple and relatively inexpensive, while affording pleating capabilities to a variety of patterns.

These and other objects, such as will be apparent hereinafter, are achieved by a pleating machine for pleating cloth with mutally converging folds, which comprises: a working platform, an angularly oscillating arm on said platform adapted to impart a cloth placed on said platform with a step-like forward movement, a lifting abutment wall adapted to contact said cloth adjacently a travel limit of said arm, and guide members effective to guide pleated cloth and being located adjacent said wall on the opposite side to said arm; the machine being characterized in that said abutment wall and said arm are both configured comb-like to be mutually interleaved, and in that control members and guiding elements are provided for said abutment wall to be subjected to cyclic oscillation from a position whereat said cloth is clamped against said platform to an inserted position in said arm after moving over and past a cloth flap which has been folded over by said arm and effective to then press said flap against said guiding members for the pleated cloth.

BRIEF DESCRIPTION OF THE DRAWINGS

Further features and advantages of the invention will be more readily understood from the following description of a preferred, but not exclusive, embodiment of this pleating machine, to be read in conjunction with the accompanying illustrative drawings, where:

FIG. 3 shows for illustration purposes a pleated cloth formed on the machine of this invention;

FIGS. 4 and 5 are, respectively, a front view and side view, partly in section, of the machine of FIG. 1;

DESCRIPTION OF PREFERRED EMBODIMENTS

Figure 1:
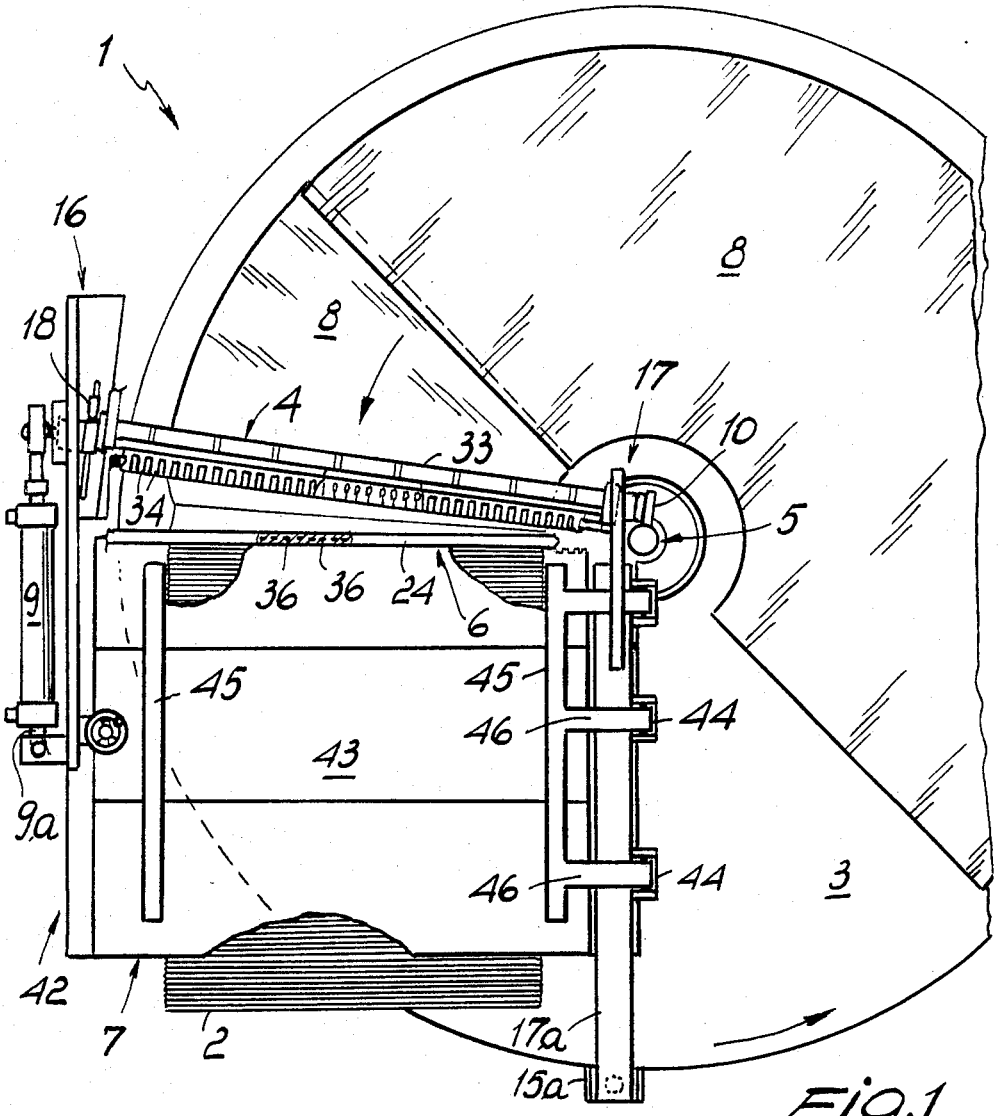
FIG. 1 is a schematic plan view of the pleating machine of this invention, with some components thereof shown cut away.

Making reference to the drawing views, a pleating machine according to this invention is shown generally at 1. The machine is set up to form a pleated cloth 2 of the type shown in FIG. 3 with mutually converging folds, and essentially comprises a working platform 3, an entrainment arm 4 mounted pivotally on the platform 3 about a pin 5, a lifting abutment wall 6 located adjacent a travel limit position of the arm 4, and guiding members 7 for the pleated cloth 2.

The platform 3 is particularly brought out in FIGS. 1,4 and 5. Its shape is circular, suitable for positioning pre-shaped, but not yet pleated, fabric portions 8, and extends around a pin 5 which forms the pivot center for the arm 4. Further, the platform 3 is peculiarly pivotable about that same pin with a timed motion to that of the arm 4.

More specifically, the platform 3 is rotated step-like concurrently with the forward movements of the arm 4 which is driven by a main cylinder 9 (FIG. 1) effective to reciprocatingly oscillate the arm 4. During the return movements of the arm 4, the platform 3 is held stationary.

Figures 6, 7:
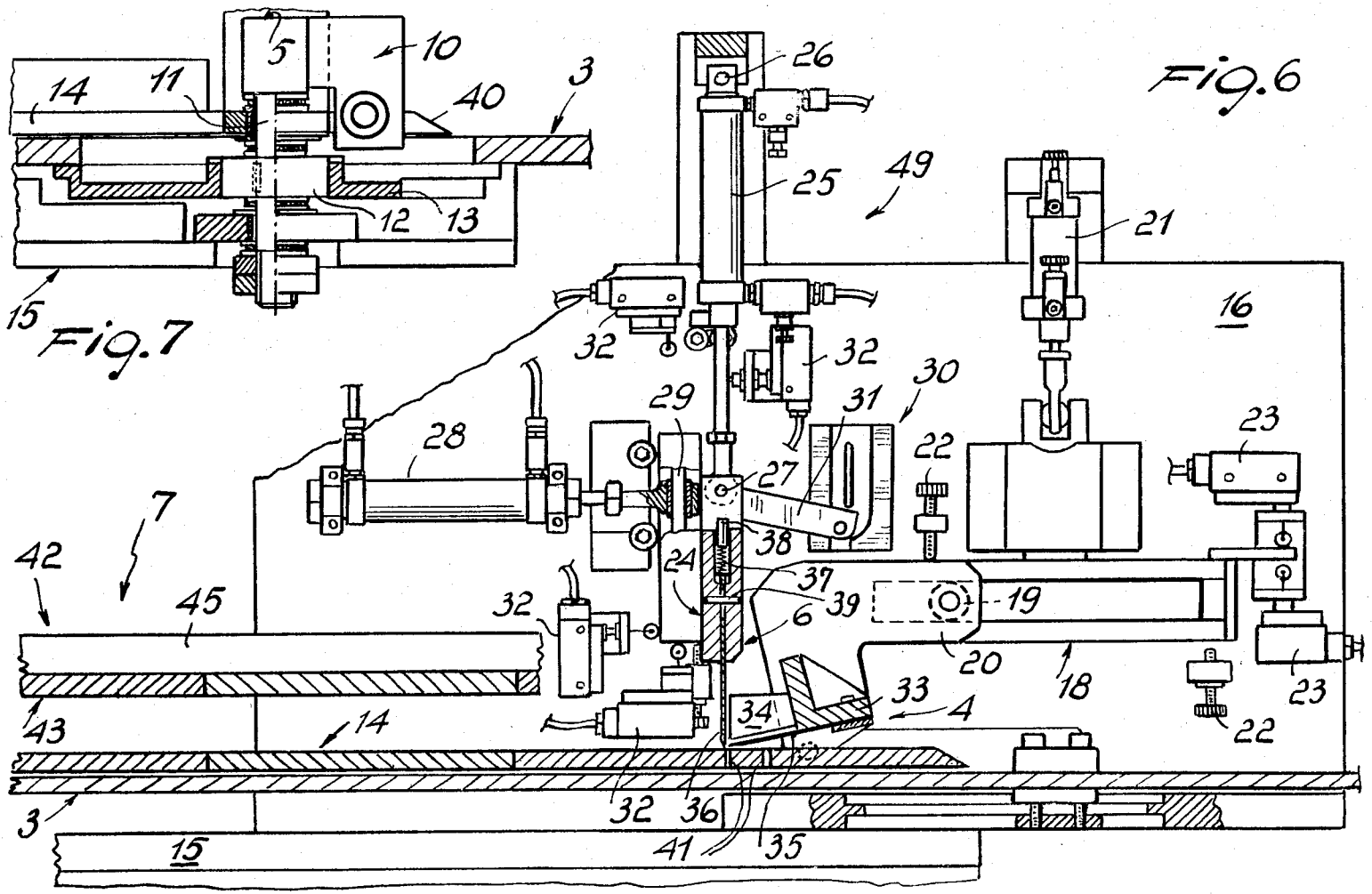
FIG. 6 illustrates the machine control members as arranged on a lateral side thereof.
FIG. 7 illustrates the machine construction in the area of its center pin.

Advantageously, it is the main cylinder 9 itself which controls both the reciprocation of the arm 4 and advancement movements of the platform 3. In fact, and as shown in FIG. 7, the arm 4 is terminated at the pin 5 with a plate 10 which is attached to a center pin 11 of the pin 5 connected to the platform 3 through a freewheel mechanism 12 for rotation in one direction only. The freewheel mechanism 12 is made rigid with the platform 3 by means of a cup-like extension 13, also shown in FIG. 7. It should be further noted, moreover, that the pin 5 is provided with a set of bearings in engagement with the various elements connected to the pivot pin, in particular, a fixed storage deck 14 overlying the platform 3 as will be explained hereinafter, and a base 15 which provides support for the pivot pin 5 and the machine as a whole.

The base 15 is particularly brought out in FIGS. 4 and 5, and comprises a latticework for direct installation on the floor.

As shown in the drawings, not only does the base 15 support the pin 5 but also a pair of lateral sides extending mainly in a vertical direction which carry substantially all of the components of the machine 1. More particularly, there are provided an outward lateral side 16 engaging with the main cylinder 9 and one end of the arm 4, and an inward lateral side 17 which extends from said pin 5 parallel to the former lateral side 16 beyond the platform 3 to connect, through an expansion sectional member 17*a* thereof, to a base beam 15*a*, as brought out in FIGS. 4 and 5. The lateral sides 16 and 17 also carry control and guiding devices 49 for the wall 6, while the controls for the arm 4 are only provided on the outward lateral side 16, since the arm 4 is merely connected to the pin 5 at the inward lateral side 17.

As shown in FIG. 6, the controls for the arm 4 are formed, additionally to said main cylinder 9, by a runway 18 along which the arm 4 can slide through a pivot pin 19 projecting from a second end plate 20 of the arm. The runway 18 extends substantially parallel to the platform 3 and may be lifted perpendicularly from the latter by means of an auxiliary cylinder 21 supported by the outward lateral side 16 and said runway 8 has its stroke length limited by adjustable mechanical travel end stops 22 and microswitches 23. In order to follow the movements of the arm 4 in the vertical direction, the main cylinder 9 has at least one end 9*a* swivel connected (FIG. 1).

The cited control and guiding devices 49 for the wall 6 are arranged to act on an upper crosspiece 24 of the wall 6, and comprise a lifter cylinder 25, suspended from an upper swivel mount 26 and ending with its rod in a lower supporting swivel connection 27 engaging directly with the crosspiece 24. Said devices 49 further comprise a translator cylinder 28 perpendicular to the lifter cylinder 25 and acting on a vertical tube 29 made rigid to the crosspiece 24. Finally, a guide 30 is provided which defines the path of cyclic movement of the crosspiece 24. The latter engages in the guide 30 through a lug 31. All the movements of the lifter cylinder 25 and translator cylinder 28, on each lateral sides 16,17, are controlled by additional microswitches 32.

Figure 2:
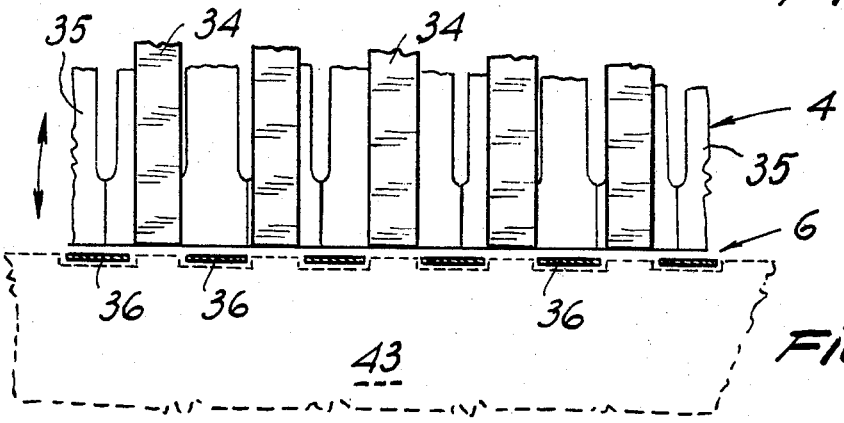
FIG. 2 is a detail view of the machine drawn to a much enlarged scale with respect to FIG. 1.

FIGS. 1,2 and 6 show the construction of the arm 4 and wall 6.

It should be noted that the arm 4 is defined, between its ends, by an angle crosspiece 33 which peculiarly supports segments 34 extending perpendicularly to the angle crosspiece 33 and being spaced apart at equal intervals. It is also contemplated that the distance separating the various segments 34 be substantially equal to the thickness dimension of each segment 34, in a parallel direction to the angle crosspiece 33 and length direction of the arm 4. The segments 34 overlap a lower blade 35, also attached to the angle crosspiece 34, which is preferably formed by a set of small blades laid side-by-side and being partly independent of each other, as shown in FIG. 2. It is further contemplated that the blade 35 be located somewhat away from the segments 34 so that it may be caused to oscillate with respect to the same. As a whole, the front portion of the arm 4 has a comb-like configuration wherein the segments 34 extend in the height direction to match the lengths of pleats to be formed.

The abutment wall 6 also has a comb-like configuration. In fact, it is defined by the cited crosspiece 24 and a set of rods 36 depending from the crosspiece 24. The rods 36 mainly extend in a substantially vertical direction, and advantageously, engage the crosspiece 24 elastically. In fact, as shown in FIG. 6, each of the rods 36 is conncted at the top, within the crosspiece 24, to a compression spring 37 the position whereof can be adjusted by means of a screw element 38. Each rod 36 is retained by means of a pin 39 passed through the crosspiece 24 and a vertically extending slot formed in the rod itself.

As brought out in FIGS. 2 and 6, the rods 36 are quite thin and extend, in a parallel direction to the crosspiece 24, over distances of smaller but comparable length to the distance separating the segments 34. Furthermore, the rods 36 extend in the height direction such that the crosspiece 24 can always be held above the segments 34. Thus, in practice, the rods 36 may be inserted in between the segments 34 of the arm 4.

The home or lowered position of the crosspiece 24 is selected to prearrange the rods 36 at the front ends of the segments 34 with the arm 4 at its foremost travel limit position. Further, in this home position, the rods 36 and blade 35 of the arm 4 will rest on the cited storage deck 14. The latter is close against the pivoting platform 3, whereto it is connected by a bevel 40. The storage deck 14, which is stationary, is extended to span the area between the lateral sides 16 and 17, at the cited guiding members 7.

As shown in FIG. 6, the storage deck 14 is formed with channels 41 adjacent the wall 6 which are connected to air jet supply members. The latter members are not shown because known per se. Further, the storage deck 14 is provided, at an intermediate portion thereof, with internal resistance heaters for heat processing a previously pleated cloth.

The guide members 7 comprise, inter alia, a cover 42 whose construction is brought out in FIG. 4. The cover 42 is substantially defined by an upper plate 43 which is supported by a lifting member 47 at the outward lateral side 16 and is at the other end pivotally connected by hinges 44 located at the expansion sectional member 17*a* of the inward lateral side 17.

As shown in FIG. 1, the upper plate 43 is subdivided into portions which are held together by sectional members 45, one of which is connected to the hinges 44 through bridge elements 46. It is further contemplated that a center portion of the upper plate 43 be provided with internally mounted electric resistors, similarly to the intermediate portion of the storage deck 14.

FIG. 2 shows how, at the abutment wall 6, the upper plate 43 is terminated below the crosspiece 24 with a serration adapted to allow it to be inserted between rods 36 of the wall 6. The segments 34 of the arm 4 are merely brought close to the upper plate 43, but it would also be possible to partly insert the segments below the plate 43, where the terminating teeth of the latter extend beyond the rods 36.

FIG. 14 to 18 show a second embodiment of the machine 1, wherein the guide members 7 are configured to define an advantageous device for heat treating and guiding the pleated cloth 2. In fact, both the storage deck 14 and upper plate 43 are equally divided into consecutive transverse portions directly and selectively joined to heating members and cooling members.

Figures 14, 15, 16:
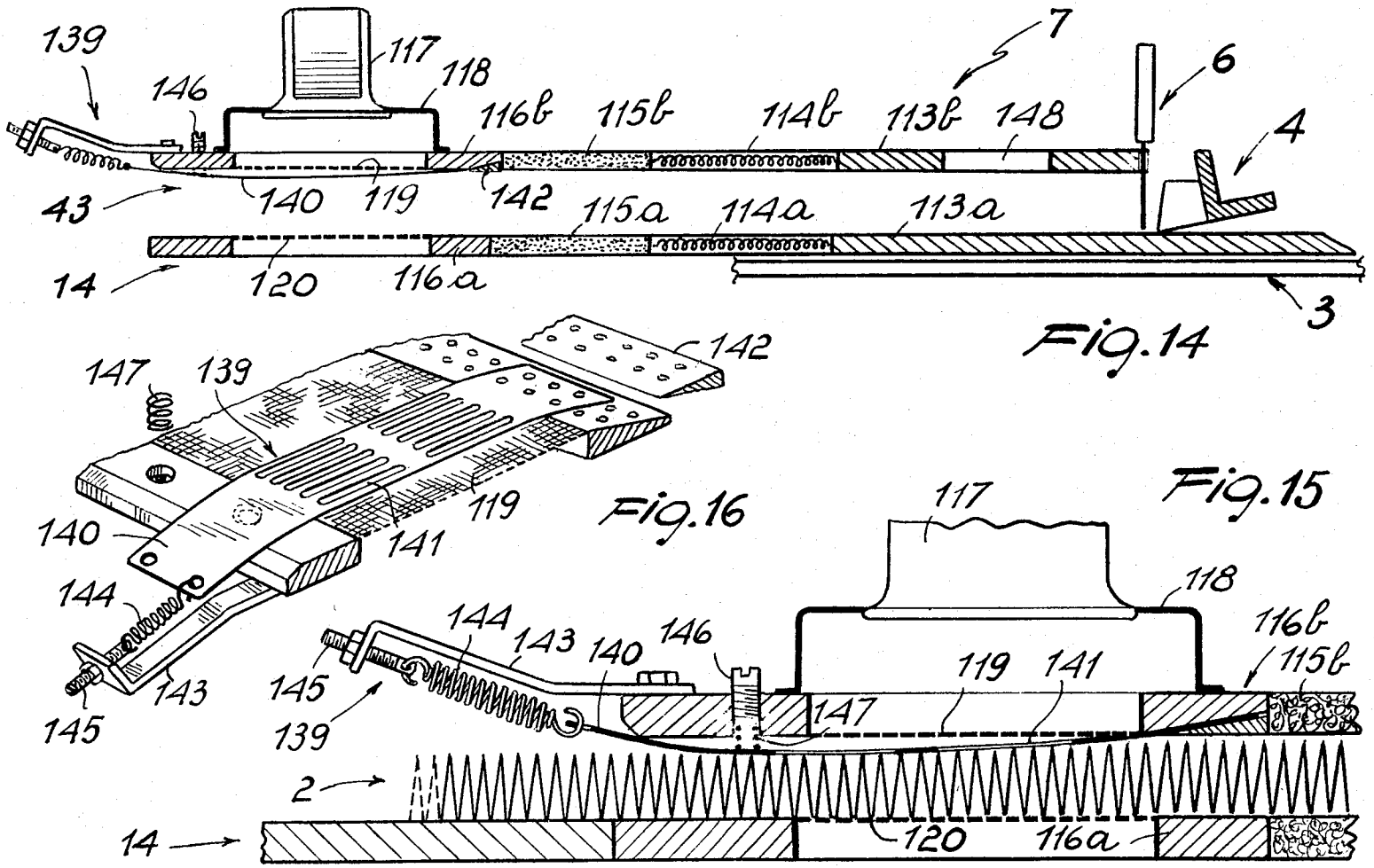
FIG. 14 is a sectional view of the pleated cloth guiding members in a second embodiment of the inventive machine.
FIG. 15 is an enlarged scale view of one portion of FIG. 14.
FIG. 16 is a perspective view showing one portion of FIG. 15 in an upside down position.

As brought out by FIG. 14, first cross portions 113*a* and 113*b* are provided, respectively for the storage deck 14 and upper plate 43, these being mere containment portions which cooperate to hold the folded flaps in a compact position. These first portions are followed by second cross portions 114*a* and 114*b*, which form proper plate heaters which may reach a very high temperature. The second cross portions 114*a*, 114*b* contain, in fact, electric resistance heaters, shown schematically in FIG. 14. The heat generated by the second cross portions 114*a*, 114*b* is conducted also to the first cross portions 113*a*, 113*b*.

Provided consecutively to the cited second cross portions are third cross portions 115*a*, 115*b*, respectively for the storage deck 14 and upper plate 43. The cited third portions serve heat insulation purposes. In fact, the same are formed from thin sheets wherebetween a thermally insulating material is interposed.

Figure 17:
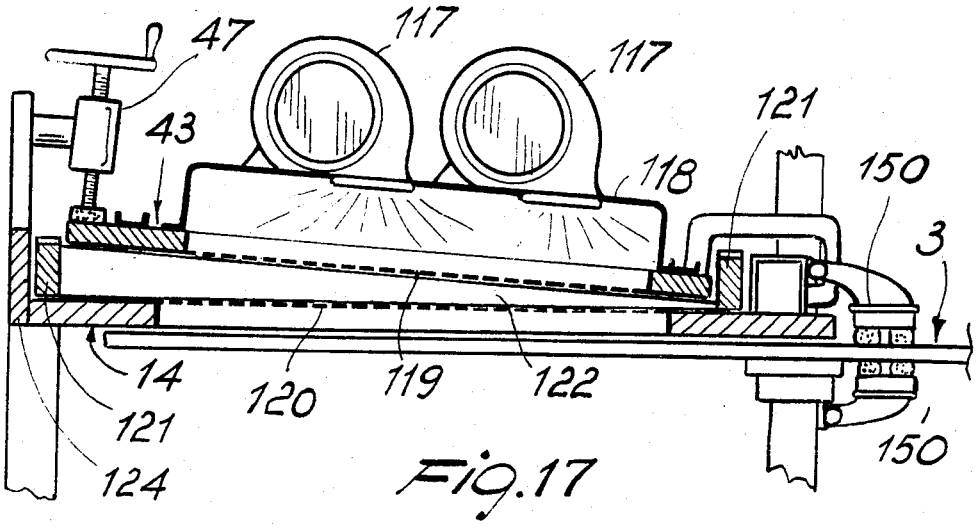
FIG. 17 is a cross-sectional view of the guiding members shown in FIG. 14.

Lastly, fourth cross portions 116*a*, 116*b* are provided the peculiar construction whereof is shown best in FIGS. 14, 15 and 17. These cross portions are directly connected to cooling members which comprise, advantageously, a pair of fans 117 adapted to blow air at a cold temperature or room temperature across the pleated cloth, in a substantially perpendicular direction to the upper plate 43 and substantially parallel to the flaps of the pleated cloth.

Originally the cooling air flow is channeled such as to follow a linear path through both the upper plate 43 and storage deck 14, virtually without escape or deflection in the perpendicular direction to the formed pleats. For this purpose, mounted on the fourth cross portion 116*b*, on one side (the outward side), is a hood 118 effective to confine the air flow generated by the fans 117, while on the other side (at the inner face), a first grid 119 is located which is substantially tailored to fit the hood 118. Of course, the fourth cross portion 116*b* would be of hollow construction between the first grid 119 and hood 118.

Likewise, the fourth cross portion 116*a*, formed in the storage deck 14, is made hollow at a broad center portion thereof, and supports the pleated cloth through a second grid 120 wherethrough the air jet from the fans 117 flows.

Of course, the first grid 119 and second grid 120 are so arranged as not to break the surface continuity of the storage deck 14 and upper plate 43.

The pleated cloth runs between the storage deck 14 and upper plate 43 at a proportioned speed to the requirements of heat treatment, on an impulse from the comb-like arm 4 which, by oscillating cyclically, continuously loads freshly formed flaps onto the storage deck 14 in cooperation with the abutment wall 6.

Figure 18:
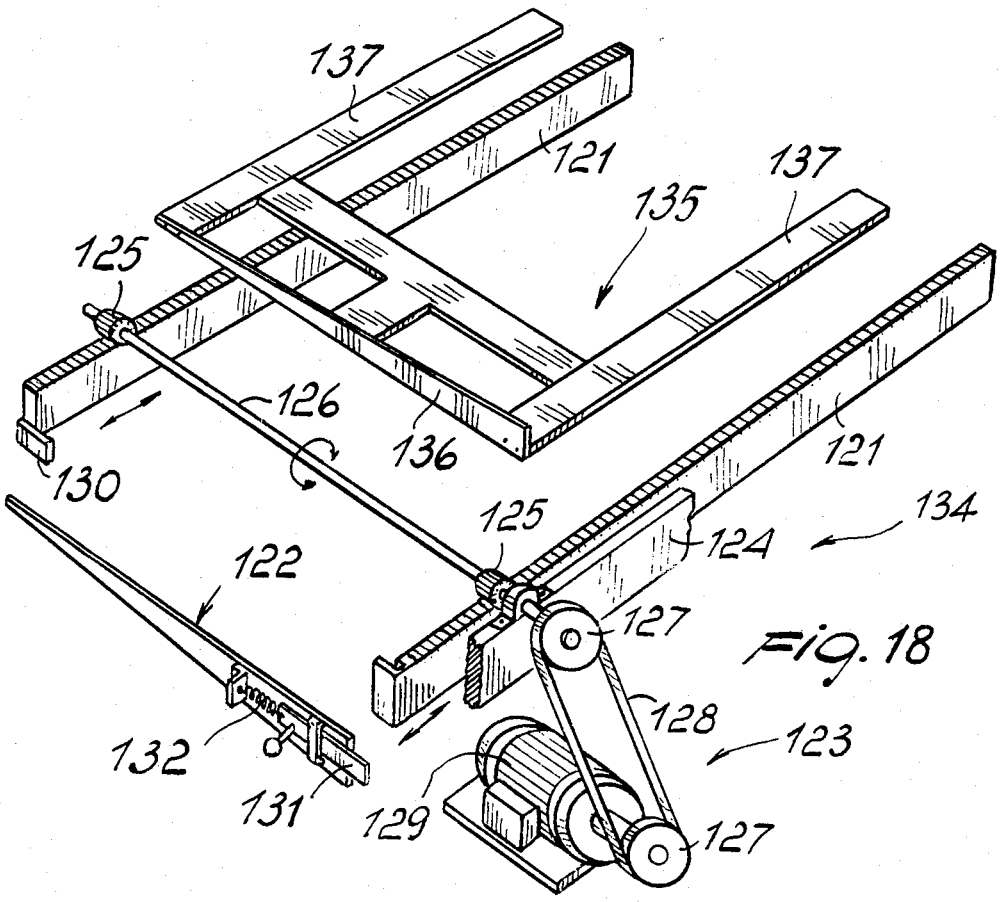
FIG. 18 is a partly exploded perspective view of a pleated cloth dragging and gathering device which may be incorporated to the machine of this invention.

In order for the heat treatment to be properly followed at the beginning and end of the processing steps and in the instance of individual cloth portions being processed, it is contemplated, according to the invention, that the storage deck 14 and upper plate 43 be engaged by auxiliary elements operative to control the cloth movement. These auxiliary elements are shown in FIGS. 17 and 18.

As shown in FIG. 17, on either sides of the storage deck 14 two racks 121 are laid which, in conjunction with a cross rod 122 and motor unit 123 (FIG. 18), form an entrainment device 134 which may be activated (once all the cloth 2 has been transferred past the abutment wall 6) by the insertion of the cross rod 122 and starting of the motor unit 123. The cross rod 122 is inserted in between the arm 4 and abutment wall 6 after the latter has been raised.

In detail, the racks 121 are driven axially by gears 125 formed on a control rod 126 extending transversely to the racks 121 and being located downstream of the upper plate 43.

The control rod 126 is rotated by the motor unit 123, which includes a pair of pulleys 127, a drive belt 128 and an electric motor 129. The latter is at a lower position than the storage deck 14, on one lateral side of the pleating machine.

The cross rod 122, which is interchangeable and shaped to match the folded flaps being formed, may be snap engaged between the front ends of the racks 121. To that aim, the cross rod 122 may be positioned with one end to abut on a projection 130 from the front of one of the racks 121, and with the other end to engage with the other rack 121, by means of a movable blade 131 which is controlled manually against the bias of a compression spring 132.

The speed imparted by the electric motor 129 is correlated functionally to the heat treatment provided for the cloth, and accordingly, will be the slower the more powerful said treatment is to be.

Finally, the stop positions for the entrainment device 134 are determined by a pair of microswitches supported on the side strip 124 and adapted to sense the position of small pegs protruding from the ends of the racks 121. The microswitches control the electric motor 129.

In cooperation with the entrainment device 134 just described, but at an independent and isolated location, a slide 135 may be arranged to operate for confining the pleated cloth on the opposite side to the cross rod 122. Whereas the entrainment device 134 is operated each time that a working step is completed, the slice 135 is operated each time that a working step is started, thereby keeping the folded flaps compactly arranged by resisting their tendency to skid until the same have reached such a number as not to require any further holding and supporting actions. The slide 135 may have various shapes and dimensions, and includes a front element 136 shaped to match flaps to be formed, and a pair of guiding runways 137 substantially slidable alongside the racks 121. The runways 137 may have various lengths and be optionally provided with wheels and bearings to avoid tripping the slide 135.

FIGS. 14 to 16 illustrate how the resistance of the pleated cloth to forward movement may be increased, to increase the degree of mutual compaction of the pleats, also at the upper plate 43 by providing additional auxiliary elements for controlling the cloth movement in the form of pressure members 139. More specifically, plural blades 140 are provided each being associated with supporting members adapted to allow them to bow. The blades 140 are arranged side-by-side at the lower strip of the fourth cross portion 116*b* of the upper plate 43. In practice, the blades 140 are set to straddle the first grid 119, and advantageously, formed with cutouts 141 not to hinder the flow of air. The cited supporting members comprise, for example, a strip 142 effective to lock one end of the blades 140, and a bridge element 143 located on the opposite side to the strip 142 and engaging with a respective blade 140 with the interposition of a tension spring 144, whose tension may be adjusted by means of a screw element 145.

FIG. 14 shows also an opening or inspection port 148 adapted to permit direct inspection of pleats just formed; the opening 148 being formed in the upper plate 43 in the proximity of the abutment wall 6.

The opening 148 is provided with a clear cloth confining element. Finally, FIG. 17 shows jaws 150 for controlling the movements of the platform 3. In particular, a first pair of electromagnetic drag jaws 150 is provided attached to the arm 4 and allowed to move along with it, as well as a second pair of electromagnetic hold-back jaws 150 which are mounted stationary (FIG. 17).

It is contemplated that the drag or pulling electromagnetic jaws engage with and entrain rotatively the platform 3, while the hold-back or braking electromagnetic jaws are held open, and the latter become likewise operative with the electromagnetic drag jaws in the open position. The jaws 150 cooperate with the freewheel mechanism 12, but alternatively, may replace it.

The operation of this pleating machine will be next described with reference to FIGS. 1 to 13.

Figure 8:
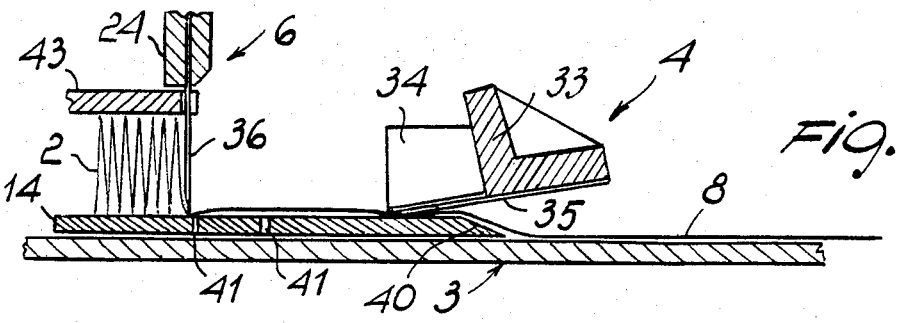
FIGS. 8 to 13 illustrate diagramatically the operation of some of the main components of this machine.
Figure 9:
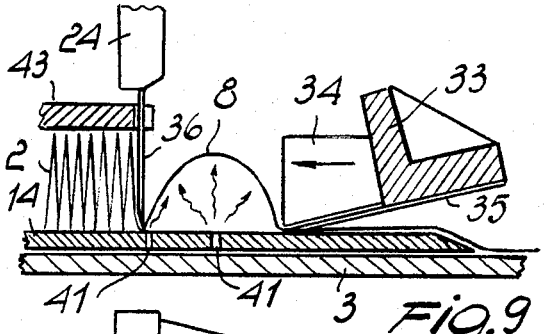

Initially the machine would be in the position shown in FIG. 8, with the arm 4 at its rearmost travel limit from the wall 6. A portion 8 of a cloth to be pleated is laid onto the platform 3. The abutment wall 6 is in its lowered position and acts as a stop for the not yet pleated cloth portion. The latter is lifted off the platform 8 and overlaps the storage deck 14, moving past the bevel 40. Any pleated cloth 2 present beyond the wall 6 is held in place by the upper plate 43 of the cover 42. The upper plate 43 enters frontally the spaces between the rods 36 of the wall 6 and moves into a cocked position (FIG. 4) defined by the lifting member 47.

To form a pleat or folded flap in the cloth, the main cylinder 9 (FIG. 1) is operated to angularly shift the arm 4 closer to the wall 6. During this movement, the arm 4 rotates about the pin 5 whereto it is connected through the plate 10, and on the opposite side runs along the runway 18 through the pin 19. During this working step the runway 18 is held lowered by the auxiliary cylinder 21 and the arm 4 engages its blade 35 with the cloth portion 8. Of preference, the blade 35 is held away from the segments 34, and accordingly, the lowered position for the arm 4 may be defined without any special problem of working tolerance, since any inaccuracies would be accommodated by the blade 35 flexing. Further, in that way, the blade 35 may adapt itself spontaneously to cloths of varying thickness and even overcome possible surface irregularities in the cloths. In this situation, the subdivision of the blade 35 into plural side-by-side blades, as shown in FIG. 2, becomes specially useful.

While the arm 4 is approaching the wall 6, an air jet is issued through the channels 41 which can favour the formation of a pleat even in the instance of exceptionally flabby cloths.

At the same time, the platform 3 is rotated along with the arm 4 by the entrainment action applied by the arm 4 itself through the freewheel mechanism 12 at the pin 5. Thus, the cloth stored on the platform 3 undergoes no pulling or tensioning effect and can retain its position without wrinkling even where particularly flabby in nature.

Figure 10:
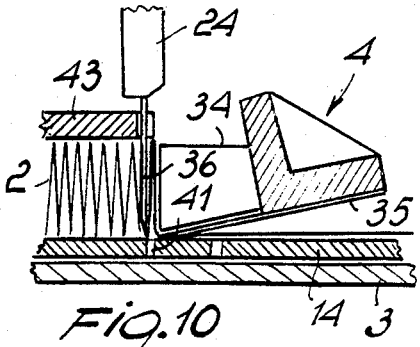

As brought out in particular by FIGS. 2,6 and 10, the arm 4 is positioned at its travel limit with the segments 34 aligned to gaps between the rods 36, thus forming and squeezing a cloth flap.

Once the new flap has been formed, and (preferably) while the same is being held in position by an air jet through a specially provided channel 41 as well as by the segments 34, the wall 6 is raised and shifted with cyclic oscillation by the action of the lifting cylinder 25 and translator cylinder 28. The path of movement of the wall 6 is dictated by the runway 18 and is such that the rods 36 can move over and past the just formed flap. and enter peculiarly the spaces between the segments 34 behind the flap itself.

Figure 11:
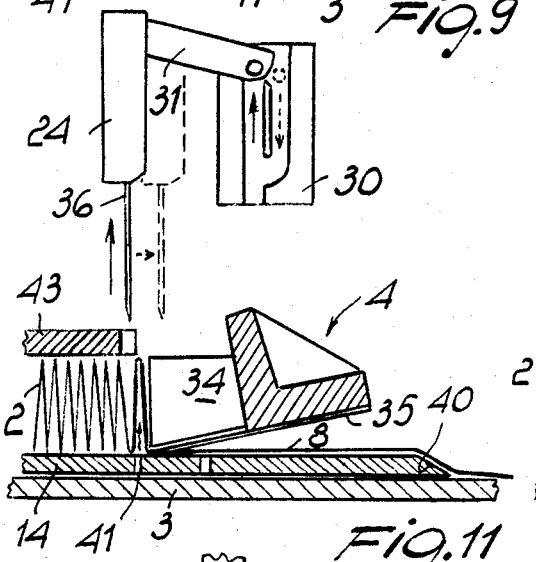
Figure 12:
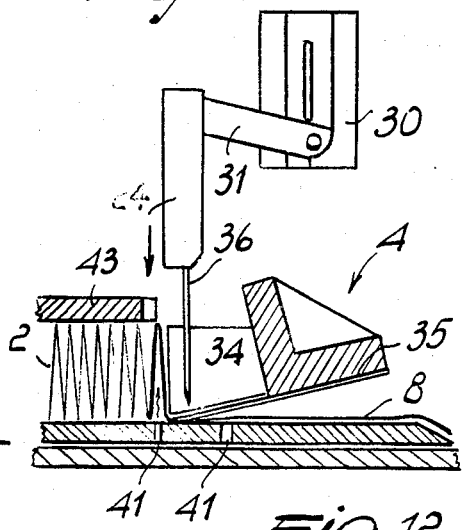
Figure 13:
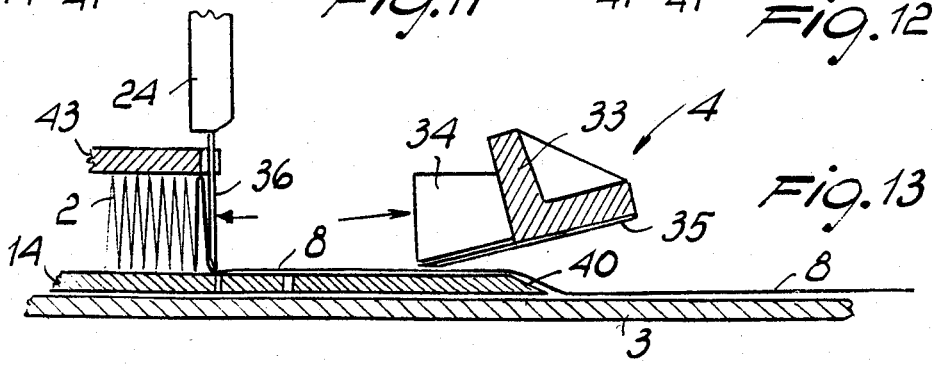

This oscillation is shown in FIGS. 11 and 12, and can only take place by virtue of the comb-like configuration of the rods 36 and segments 34. Not only does the comb-like configuration allow insertion of the rods in between the segments but also the rods themselves to be raised without any effect of entrainment of the just formed flap.

In fact, in no case would the segments 34 press the flap in question against the rods 36 and the same present a much totally reduced contact surface to the flap.

During the last portion of the cyclic oscillation, the rods 36 urge the just formed flap toward the guiding members 7 for the pleated cloth 2, where the cloth undergoes a heat treatment resulting from the provision of heated zones at the upper plate 43 of the storage deck 14.

During this final portion of the cyclic oscillation, the rods 36 may interfere with some force with the blade 35 of the arm 4 and/or the storage deck 14. This because the rods 36 are spring mounted according to the invention and hence able to readily accommodate the cyclic oscillation imparted to them as well as the thickness of the pleated cloth.

Finally, the arm 4 is moved rearwardly and lifted by the action of the main cylinder 9 and auxiliary cylinder 21, the latter being operative to raise the runway 18. During this movement, the platform 3 is held stationary, because the freewheel mechanism 12 is configured to only transmit to the platform 3 the movements of the arm 4 toward the wall 6.

Thus, the pleating machine 1 can return to its original condition, as shown in FIGS. 1 and 8. Pleating is continued to completion of each cloth portion 8 or, expediently, in a continuous fashion so as to pleat without interruptions various portions 8 laid sequentially onto the platform 3, as shown in FIG. 1. This continuous process is made possible by the rotary movement of the platform 3, which spontaneously feeds in the cloth to be pleated and avoids tensioning and pulling it.

In the embodiment of FIGS. 14 to 18, full heat treatment of the pleated cloth is also carried out. In fact, the machine first applies heat to the cloth and then cools it off. Cooling is most effective because actual tests have shown that mere heating may not be sufficient; in exiting the machine, the "upright" pleats tend spontaneously to open up and let the cloth lay down. This partial collapse produces permanent adverse effects, since the cloth would still be hot. It is, therefore, necessary to not only heat but also cool for the completion of the entire heat treatment cycle prior to the pleats leaving the machine that formed them.

The inventive device offers qualitatively very high results: the resulting pleats are permanently stable. When the machine processes individual cloth portions, or possibly just a few wearing apparel articles, the machine stops while a large part of the pleated cloth is yet to move through the cited heat treatment device. Under no circumstances can the cloth be removed manually because this would result in the pleats collapsing and in an imperfectly controlled residence time of the same in the heat treatment area.

The situation is serious during the adjustment procedure of the heat treatment device, when just individual clothing articles are fed thereinto for testing purposes.

With the entrainment device 134 and slide 135 adjustment of the device operating parameters is also facilitated where cloth portions of very short length are to be treated. The treatment of hemmed cloths also poses no problems because the cloth running may be adjusted as desired by means of the pegs 146 acting on the blades 140.

In fact, an edge of the pleated cloth may include a hem which, owing to its thickness, would tend to distort the pleated cloth into a fan-like shape. Thus, a more powerful frictional action must be applied to the hem area to prevent the mutual compaction of the cloth flaps from being reduced.

The invention as disclosed is susceptible to many modifications and variations without departing from the scope of the instant inventive idea. Further, all of the details may be replaced with other, technically equivalent elements.

In practicing the invention, the materials used and dimensions may be any selected ones contingent on individual requirements.

I claim:

1. A pleating machine for pleating cloth with mutually converging folds, comprising: a working platform, an angularly oscillating entrainment arm on said platform adapted to impart a cloth placed on said platform with a step-like forward movement, a lifting abutment wall adapted to contact said cloth adjacently a travel limit position of said arm, and guide members effective to guide pleated cloth and being located adjacent said wall on the opposite side to said arm, characterized in that said abutment wall and said arm are both configured comb-like at least in part so as to be mutually interleaved, and in that control and guiding devices are provided for said abutment wall to be subjected to cyclic oscillation along a path leading said abutment wall to an inserted position in said arm after moving over and past a cloth flap which has been folded over by said arm and effective to then press said flap against said guiding members for the pleated cloth.

2. A pleating machine according to claim 1, characterized in that said arm comprises a plurality of segments extending perpendicularly to said platform side-by-side and at a distance from one another, and a blade located below said segments and being adapted to interfere with said cloth placed on said platform, said segments having the front portions thereof extended to the same height as the flaps to be formed and being arranged to press a flap in the cloth against openings in said comb-like wall.

3. A pleating machine according to claim 1, characterized in that said arm is engaged at one end with a perpendicular pin to said platform defining the rotation axis for said arm, and at the opposite end with a runway extending substantially parallel to said platform and being raiseable by an auxiliary cylinder located substantially adjacent to said runway parallel thereto.

4. A pleating machine according to claim 1, characterized in that said wall comprises a crosspiece extending substantially parallel to said platform and a plurality of rods extending parallel to one another from said crosspiece toward said platform, and in that said rods are engaged with said crosspiece, in an oscillating way, in the main direction thereof.

5. A pleating machine according to claim 1, characterized in that said control and guiding devices for said wall comprise, at each end of said wall, a lifter cylinder and a translator cylinder acting on said wall, as well as a runway adapted to define, through a connection lug to said wall, a closed loop path extending mainly in a perpendicular direction to said platform.

6. A pleating machine according to claim 1, characterized in that said platform is rotatable jointly with said arm as the latter is rotated toward said wall, and in that said platform is rotatable about said same pin which defines the rotation axis of said arm.

7. A pleating machine according to claim 1, characterized in that it comprises a storage deck for pleating cloth being formed on said platform from said wall and provided, at the wall itself, with channels adapted to admit a flow of air tending to bow a cloth flap being pleated.

8. A pleating machine according to claim 1, characterized in that it comprises a storage deck for the pleated cloth overlaid by an upper plate adapted to be positioned obliquely on said storage deck, and in that said storage deck and upper plate are subdivided into consecutive portions selectively connected to heating members and cooling members.

9. A pleating machine according to claim 8, characterized in that both storage deck and said upper plate are subdivided into at least one first transverse portion with containment functions, a second transverse portion with heating functions, a third transverse portion with heat insulation functions, and a fourth transverse portion associated with said cooling members.

10. A pleating machine according to claim 8, characterized in that said cooling members comprise elements adapted to generate a forced air flow in a substantially parallel direction to the flaps of the pleated cloth, and in that said cooling members act at openings formed in said upper plate and said storage deck, said openings being engaged by grids effective to provide continuity for the surfaces in contact with the pleated cloth.

11. A pleating machine according to claim 8, characterized in that it comprises auxiliary elements adapted to control the movements of the pleated cloth and including pressure members in the form of flexible blades located below said upper plate and associated therewith through supporting members of an at least partially elastic nature and being adapted to allow bowing of said blades, and in that said bowing is produced by pegs passing through said upper plate and acting on said blades.

12. A pleating machine according to claim 1, characterized in that it comprises auxiliary elements operative to control the movements of the pleated cloth and including an entrainment device provided with racks set solidable laterally to the pleated cloth, a motor unit operative to drive, through gears, said racks forward and backward along a parallel direction to the direction of advance of the pleated cloth, and a cross rod adapted to interconnect said racks and control the forward movement of the pleated cloth.

13. A pleating machine according to claim 11, characterized in that said auxiliary elements adapted to control the movements of the pleated cloth further include a slide moving in a parallel direction to the direction of advance of the pleated cloth and adapted to enter the gap between said racks, said storage deck and said upper plate.

14. A pleating machine according to claim 1, characterized in that it comprises a first pair of electromagnetic drag jaws for said pivoting platform, as engaged by said arm, and a second pair of electromagnetic holdback jaws for stopping said platform.

* * * * *